United States Patent [19]

Stout

[11] 3,950,902

[45] Apr. 20, 1976

[54] CONCRETE STRUCTURE INCLUDING MODULAR CONCRETE BEAMS

[76] Inventor: Robert K. Stout, Hamburgo 75 Pent House Suite, Mexico City 6, Mexico

[22] Filed: Feb. 18, 1975

[21] Appl. No.: 550,172

Related U.S. Application Data

[62] Division of Ser. No. 399,087, Sept. 20, 1973, Pat. No. 3,908,324.

[52] U.S. Cl. ..... 52/91; 52/241; 52/264; 52/295; 52/607; 52/262

[51] Int. Cl.[2] ..... E04B 1/38

[58] Field of Search ..... 52/606, 607, 91, 262, 52/250, 251, 259, 234, 259, 241, 264, 295, 261

[56] References Cited

UNITED STATES PATENTS

| | | | |
|---|---|---|---|
| 2,091,061 | 8/1937 | Waugh | 52/262 |
| 2,184,714 | 12/1939 | Freeman | 52/250 |
| 2,192,182 | 3/1940 | Deutsch | 52/250 |
| 2,883,852 | 4/1959 | Midby | 52/241 |
| 3,330,084 | 7/1967 | Russell | 52/241 |

*Primary Examiner*—John E. Murtagh
*Attorney, Agent, or Firm*—Anthony J. Casella

[57] ABSTRACT

A complete concrete structure, especially houses, having any desired architectural form and appearance is constructed in a series operations wherein the foundation, the interior and exterior walls, and the floor are constructed at the situs from a single basic, monolithic pre-cast modular concrete beam. Each beam is an elongated concrete member having a generally rectangular cross-section, and having a central aperture extending through the length of said beam. In addition, two opposite sides of the beam are provided with a plurality of lateral holes, and said sides are configured to have a longitudinally extending tongue and groove arrangement so that abutting modular concrete beams will interfit with one another. Either one or both of the other two opposite sides of the beams may be architecturally finished, depending on whether the beam is to be employed as forming a portion of the foundation, the upstanding walls, or the roof structure. The required electrical, plumbing and reinforcing elements, extend through the respective openings in the beams, and in addition to the tongue and groove interconnection between adjacent beams, a plurality of specially shaped connector members are provided for securing adjacent modular concrete beams together. In another embodiment of the modular concrete beam, the beam is formed of a composite structure comprising an internal hollow mold of frangible material such as polystyrene in intimate contact with an external concrete structure. The ends of the internal polystyrene mold as well as projections extending along the longitudinal sides thereof are exposed whereby the frangible ends or side projections may readily be cut out to enable the routing of service lines through the composite modular concrete beam.

9 Claims, 24 Drawing Figures

262
260
10
262
270
266
265
268
264
30
290
130
102
10
30
292
260
292
10
120
284
250
280
144
142
146
150
260
30
10
192
30
10
260
284
280

CONCRETE STRUCTURE INCLUDING MODULAR CONCRETE BEAMS

This is a division of application Ser. No. 399,087, filed Sept. 20, 1973, now U.S. Pat. No. 3,908,324.

BACKGROUND OF THE INVENTION

1. Field of the Invention

The invention relates to concrete building structures and more particularly a building structure and a method of constructing same employing pre-cast modular concrete beams and columns that may be manufactured at the site of the concrete structure. The beams and columns are configured so as to enable the structure to be assembled rapidly, with the modular concrete beams and columns being used to construct the foundation and floor, walls and roof of the concrete structure. In other words, a complete concrete structure is made from one basic member.

2. Description of the Prior Art

Despite the tremendous effort made by the largest companies of the most industralized nations in the world to bring housing construction methods into the twentieth century by industrializing the centuries old methods of hand-making a house by assembling many materials, thousands of pieces, piece by piece with many skilled craftsmen, requiring days or months to build, these efforts have been unsuccessful. This is attested to by the fact that there just are no universally successful systems for housing in the world today, in spite of the critical housing need. Prefabricated and modular housing have been the direction in which most efforts have been made because it was recognized that potentially the best way to construct houses or other structures was with a basic unit or module which would be composed of finished surfaces, be structural and durable, self-insulating and go together to form a structure in a simple manner, such as putting together children's building blocks.

The problem has been that the prefabricated and modular housing industries have simply transferred to a factory these same thousands of pieces, many different materials, many processes and many skilled crafts required, used in the age old construction methods. The cost of the structure completed on the site has not been significantly reduced nor has the modular or prefabricated system significantly reduced the number of skilled crafts required, the many different materials and thousands of pieces required, has not reduced the number of many different steps needed in the construction process, and has only partially reduced the total number of man hours required in the construction process.

That the problem is very complex is attested by the fact that although a great effort has been made to solve the problems, the modular or prefabricated housing industries have only captured an extremely small percentage of the housing market, perhaps as little as 5% after many decades.

The concept of the single building block or module is the correct approach but many complex elements must be a part of the building block, which heretofore have been missing, to make it successful and to solve the problems.

Defining the problem then — it is to develop a single unit composed of only two or three materials that is structural, insulative and finished on both surfaces, that can be used interchangeably for floors, walls and roofs, that is light enough to be man handled, does not require heavy machinery at the job site, that can be mass produced at the job site but does not require expensive factories, and hence does not occasion great shipping costs, that can build any plan or architectural style and meet any structural requirement, that can be reinforced to resist any dynamic force, that is fireproof, rotproof, vermin-proof, that can be produced from two or three locally available materials and can be put together in a simple manner by unskilled people into an integrated system to form a structure that is virtually complete in one process. This is a big order and heretofore no single unit or single system has combined all of these elements.

First of all a pre-cast concrete unit is the only type of unit that can have any possibility of meeting these many and complex requirements. Even though there have been many, perhaps a thousand of pre-cast units created and many pre-cast concrete systems, not one of these units or systems has met the outlined requirements or combined a combination of even enough of the most important requirements to be universally successful as there just are no universally acceptable precast concrete housing systems. For example, some precast systems are produced in factories, but by the time they are shipped to the job site and put together with heavy machinery the process eliminates any cost savings. Thus, the unit must be able to be mass produced, economically at the job site, and be able to be man handled. Experience has taught that no system, whether pre-cast, cast at the site or whatever, involving heavy equipment and complicated machinery will be successful in housing construction since highly skilled personnel will be required thereby significantly increasing construction costs. Therefore, the requirement that the unit must be able to be man handled is critical.

The pre-cast units with most potential developed heretofore did not provide the necessary means to combine the units into an integrated system that would produce a complete structure and which could be integrally reinforced to meet any of the great variety of critical structural requirements in the building structure itself, nor did they provide for tying all the elements into a monolithic structure with each unit functioning together as a whole.

In summary, the construction industry has continually sought a solution to the problem of building houses of complex design in any architectural style utilizing a basic modular element. The theory has been that if such a basic modular element could be employed, it would greatly reduce the cost of construction, as well as reduce the number of skilled artisans required; reduce the number of and different kinds of material required for construction; reduce the number of different steps in the construction process; and greatly increase the speed of construction in order to satisfy one of mankind's most pressing problems, especially with respect to the construction of low cost housing. Several systems have been developed, all of which relate to the use of concrete which is most capable of providing security against the adverse elements of weather, earthquake, fire and vermin, however, all of such systems have certain significant shortcomings. One such system or technique involves the preliminary erection of a structural steel skeleton arrangement made of I-beams, followed by the placing of large slabs of concrete panels (which are pre-cast at a factory) between the beams. The concrete panels are usually very large, in order to minimize the cost of construction, and hence resort must be made to the use of heavy equipment to transport the panels and to position the panels between the I-beams. Usually this system is only employed with respect to building the up-standing walls of the building structure, whereby resort must be made to conventional building roof techniques to complete the structure. Another disadvantage of this system is that it requires heavy equipment, involves piecemeal construction, and most importantly, requires a huge capital investment in a factory (that necessarily must be remote from the building site) for producing the pre-cast panels. Clearly this technique may not readily be economically employed for the construction of low cost housing in remote locations, where the need for housing is the greatest.

Another known technique for forming concrete buildings is to cast the building in place, by employing a plurality of individual concrete forms that are temporarily secured together to form the wall members, into which the casting concrete is poured. Often these individual forms are made of heavy metal which necessitates the use of construction equipment, with the forms being so constructed that only one design or type of structure can be made. Furthermore, the forms are employed for making the walls of the building, after which conventional roof techniques are employed for completing the structure. Because of the number of pieces of forms that must be assembled, skilled supervisory personnel must constantly be on the job to insure that the forms are properly assembled prior to the casting of the concrete.

Still another technique for forming a concrete structure involves the use of extremely large concrete forms, some large enough to complete major wall portions of a building structure. One obvious disadvantage of this technique is the requirement for heavy equipment for transporting and positioning the forms. After the forms are in position, moist concrete is poured or cast-in-place at the site of the building structure. As in the other techniques, usually a conventional roof structure is then employed for completing the building.

There are many other techniques that are employed for constructing concrete buildings, including a technique where a complete room is constructed at a factory, transported to the job site and several "rooms" are interconnected so as to complete a structure. As noted above with respect to the first mentioned technique, this system requires a huge capital investment for the construction of a factory in order to pre-cast the entire room structure. The costs attendant with the pre-casting of the structure, the transporting to the job site and the problems attendant with the interconnecting of the several rooms usually result in a system where little cost saving is achieved, skilled labor is still required, and little variation in architectural style between adjacent buildings is achieved because of the limitations on variations of the buildings, since they are pre-cast at a central factory.

In light of the shortcomings of the prior art, the system of the present invention is designed to achieve a concrete structure, such as a house, which may be of complex design, in any architectural style, by the interconnection of modular concrete beams, each of which is uniquely constructed so as to be handled by manual labor, readily interconnected, and capable of being combined to result in a complete concrete structure having any desired architectural style or form.

OBJECT OF THE INVENTION

It is the object of the invention to overcome the problems of prior art techniques of concrete building systems and particularly pre-cast concrete systems by the development of a single monolithic basic construction unit that will meet the great number of critical and complex construction requirements that no other system has successfully accomplished to date.

It is understood that the term "building structure" should not be interpreted to be limited to residential construction but also encompasses industrial buildings, apartment buildings, warehouses, and in fact, structures of any kind.

It is further an object of this invention to provide a complete pre-finished concrete structure including foundations and floors, exterior and interior walls and roof structure, all of which are made by the interconnection of the single basic interchangeable, modular, concrete beam unit to be also used as a column, of a new and unique configuration that serves the several functions of structural elements and finished surfaces, in other words, the completely finished floors, walls and roof of the structure which are self-insulating and can be adapted to any design, architectural plan or any type of structure.

It is a further object of this invention to provide a single monolithic unit composed of only one or two materials that is structural, insulative and finished on both surfaces, that can be used interchangeably for floors, walls and roofs, that is light enough to be man handled, that can build any plan or architectural style and meet any structural requirement, that can be reinforced to resist any dynamic force, that is fireproof, rot proof, vermin proof, and that can be assembled in a simple way by unskilled people.

A further object of the invention is to combine this single construction unit into an integrated system which in one basic operation by unskilled men will produce any type of structure of any architectural style or design, and with the units functioning as a monolith to meet any of a multitude of structural requirements without exterior supports, or reinforcing.

Another object of the invention is to mass produce the modular units at the job site with simple molds, eliminating the need for expensive factories and eliminating prohibitive shipping costs.

It is a further object of the invention to produce a unit which can be used to construct almost any structure of any design or structural requirement and which weighs only 400 to 500 pounds, and that can be man handled and erected by unskilled men in a single simple operation without the need for heavy equipment.

It is a further object of the invention to provide a floor, intermediate floor and roof system that allows for the integral installation of plumbing, wiring, heating and cooling, and other mechanical elements.

Another object of this invention is to provide means within the unit itself for interconnecting units so as to eliminate deflection between the units.

A further object is to provide the means of extending the unit on the job site to meet variable structure and span requirements while maintaining the strength of the unit.

It is a further object of this objection to provide a complete, concrete structure, including foundation, exterior and interior walls, and roof structure, all of which are made by the interconnection of modular concrete beam units of a new and unique configuration that serve the dual function of structural elements and architecturally finished surfaces (both interior and exterior).

It is a still further object of this invention to provide a concrete structure that is produced economically, is adaptable to mass production techniques, is constructed utilizing a minimum number of and kinds of construction units, is readily constructed and results in a superior building structure.

Another object is to provide a concrete structure that allows for adaptability to any plan, dimension, and architectural style and design, including multi-story building structures, intermediate floors of any size, a roof of varied pitch, size, and overhang structure, and including electrical and plumbing conduits extending through the modular concrete beams making up the concrete structure.

Similarly, it is an object of the invention to provide a concrete structure which may be readily constructed utilizing unskilled labor.

It is still a further object of the invention to provide a concrete structure made of interconnecting modular concrete beams that may be, in turn, constructed at the job site, thereby eliminating the necessity for huge capital investments for factories for preparing the precast modular concrete beams. In addition, such modular concrete beams may be readily handled by laborers, thereby obviating the necessity for heavy construction equipment.

These and other objects and advantages are realized by the present invention, which provides a unique concrete structure, along with a unique method of making same, wherein modular concrete beams are employed, each modular concrete beam being an elongated concrete structure on the order of 20 feet, having a generally rectangular cross-section, with a round longitudinal aperture extending the length thereof. Two opposite sides of the modular concrete beam are formed, respectively, in a tongue and groove configuration, whereby adjacent abutting modular concrete beams interfit together, and wherein each opposite side is provided with a plurality of round, tapered holes, in order to enable lateral access between abutting modular concrete beams. Furthermore, the other two sides of each modular concrete beam, constituting the upper and lower surfaces thereof, may be architecturally finished, whereby when such modular concrete beams are interconnected, an architecturally finished concrete surface is defined. For additional lateral support of interconnected beams, specially shaped connecting members are provided to be accepted within the tapered round holes of abutting beams. In addition, a vertical wall made by interconnecting a plurality of modular concrete beams are maintained in alignment by a channel-shaped, elongated member, with suitable bolting means being provided for attaching an upstanding wall of modular concrete beams to the foundation and roof, both also made of modular concrete beams. A complete building structure, such as a house, made of modular concrete beams of the subject invention inherently includes a labyrinth of internal passageways for accepting the various required service conduits such as water pipelines, sewage pipelines, gas lines, electrical conduit, etc. Utilizing various combinations of different embodiments of the subject modular concrete beam, a commercially acceptable concrete building structure of any architectural design or size may be constructed. In an alternate embodiment of the modular concrete beam, the beam is made of a composite construction including an internal hollow mold made of polystyrene material surrounded by a concrete structure, with portions of the mold being exposed so that, by cutting out the exposed portions of the frangible polystyrene mold, access may readily be had to the interior of the modular concrete beam for the routing of service lines.

DESCRIPTION OF PREFERRED EMBODIMENTS

In general, FIGS. 1–7 and 21–23 illustrate in detail the construction of several embodiments of the modular concrete beam of the subject invention, while FIGS. 8 through 20 illustrate the use of the modular concrete beam, in order to construct a new and improved concrete structure, as well as method of making such concrete structure.

Figure 3:
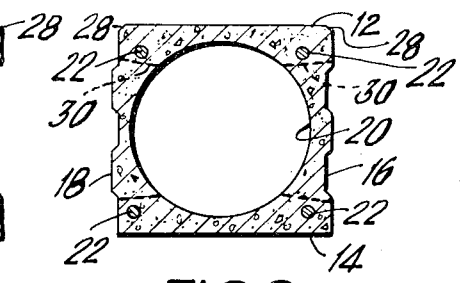
FIG. 3 is a sectional view of the modular concrete beam taken along line 3—3 in FIG. 2.
Figure 2:
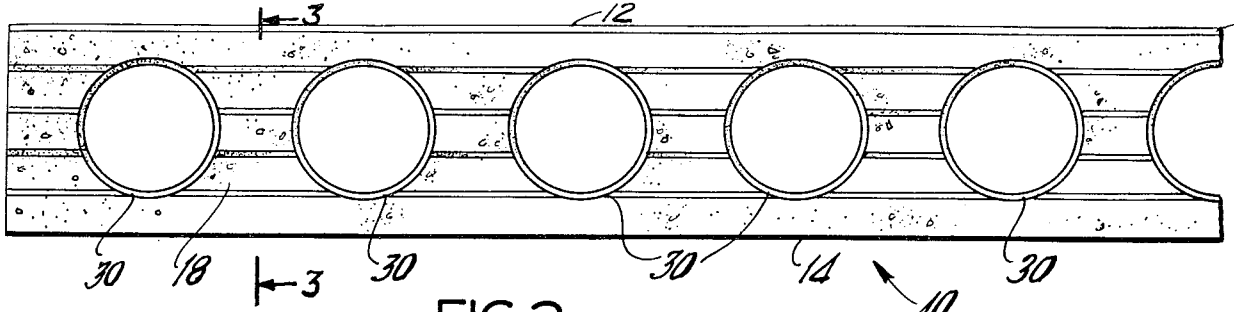
FIG. 2 is a side view of the modular concrete beam of the subject invention.
Figure 1:
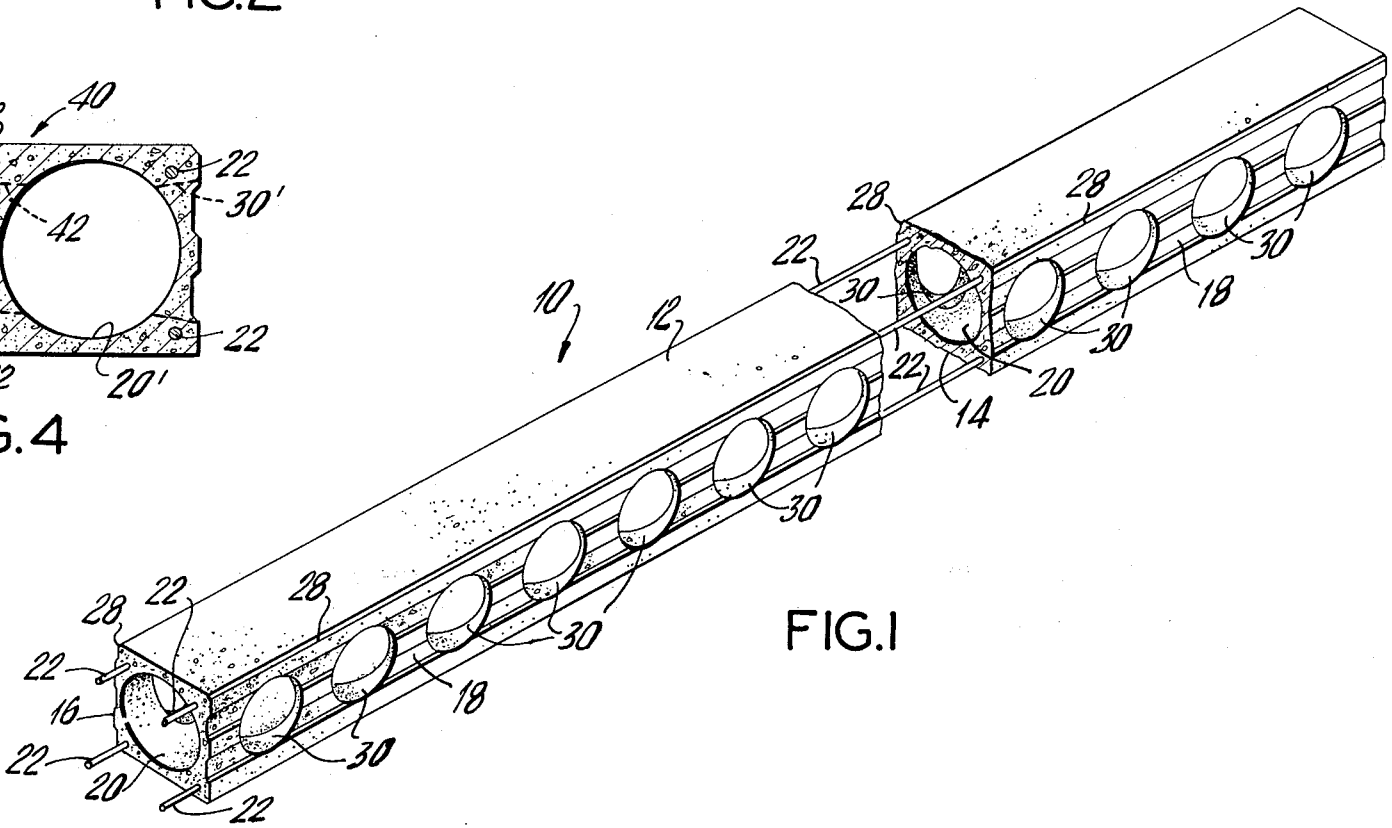
FIG. 1 is a perspective view, partly in section, of the modular concrete beam of the subject invention.

Referring to FIGS. 1 through 3, the basic modular concrete beam 10 comprises an elongated concrete structure on the order of 20 feet, which weighs about 400 pounds, so that it may be easily manipulated by laborers, thereby obviating the necessity for heavy construction equipment. The elongated modular concrete beam 10 is generally rectangular in cross-section, and referring to FIG. 3, is square in cross-section, and includes a top surface 12, a bottom surface 14, and two opposed side surfaces 16 and 18. The length of the modular concrete beam is much greater than the longest side of the cross-section of the beam, and at least eight times greater. Thus, for a modular concrete beam of 1 foot square, the length of the beam 10 may be from 8 feet to approximately 20 feet, depending on the structural requirements for the beam.

The modular concrete beam may be 6 to 10 inches high by 8 to 16 inches wide in cross-section, and of variable length up to 30 feet, and is designed to span this length without intermediate support. The beam generally weighs from 400 to 500 pounds and can thus be man handled, and erected by unskilled men in a single, simple operation for the entire structure without the need for any heavy equipment.

Extending centrally through said modular concrete beam 10 is a longitudinal aperture 20, having a round cross-section. Aperture 20 extends throughout the entire length of the concrete beam, and is formed during the casting of the modular concrete beam, as more fully described hereinafter. Also extending longitudinally along the length of the modular concrete beam are a plurality of reinforcing bars, designated by the numeral 22, in order to provide additional tensile strength to the modular concrete beam. The top corners of the beams are beveled, as at 28. Accordingly, when two modular concrete beams are interconnected along their length, the abutting side bevels 28 define a V-shaped groove along the top surface of the assembly. Suitable sealing material 29 (see FIG. 7), such as caulking or other water sealing material, may be provided in the V-shaped groove to provide sealing for the structure, in addition to the weather tight sealing achieved by the cooperating tongue and groove connection.

Referring particularly to FIGS. 2 and 3, the modular concrete beam 10 also includes a corresponding plurality of spaced round holes 30 extending through the side walls 16 and 18. Holes 30, in the respective side walls, are in opposed relationship to provide a plurality of transverse passageways through the modular concrete beam. Each hole may be of uniform diameter or tapered across the width of the respective side walls 16, 18, with its largest diameter being at the outer surface of the side wall. As clearly illustrated in FIGS. 1 through 3, the combination of the longitudinal aperture 20 and the transverse holes 30, provides a labyrinth of internal passageways within the modular concrete beam, in order to achieve several distinct advantages. Firstly, without compromising the structural integrity or load carrying capability of the modular concrete beam 10, the provision of the central round aperture 20 and the transverse, tapered round holes 30 reduces the total dead weight of the modular concrete beam, to a value where it can be readily handled by hand labor. Hence, there is no requirement for the use of heavy construction equipment when such modular concrete beams are employed in the construction of a building structure. This is of particular importance with respect to the use of the modular concrete beam for the construction of building structures in remote locations where the critical housing need is most pronounced. As more fully mentioned hereinafter, the modular concrete beam 10 may be cast at the situs of the building structure, and after proper curing, may be readily handled by manual labor in order to complete an entire concrete masonry structure. In view of the fact that most people in the world today live in countries where masonry construction is essential, because of the necessity to provide adequate protection against the adverse elements of weather, earthquake, fire and vermin, and in further view of the fact that heavy construction equipment is not readily available in most remote locations of the world, this "light weight" feature of the modular concrete beam of the subject invention is most important. Secondly, when the modular concrete beam of the subject invention is assembled together in a concrete building, the transverse holes 30 of adjacent beams are aligned thereby providing a labyrinth of interconnecting passageways which are utilized by the building trades for the ducting of utility lines, such as plumbing pipes, electrical conduits, gas lines, et cetera, as well as providing internal passageways within the structure for receiving reinforcing members such as headers for positioning over passageways, including doors and windows.

More specifically, the openings in the interior of the beams allow access to the interior of the beams for invisible interconnection of service lines such as plumbing, wiring, etc., as well as integrally providing ducts for conduction of the flow of heating or cooling fluids or gases. They serve as the invisible channels for the mechanical trades, and also allow for the insertion of hidden reinforcing rods which enable the beams to meet any of the myriad structural requirements of a complex structure without exterior support.

Still another advantage achieved by the specific configuration of the modular concrete beam of the subject invention is that the transverse holes 30 provide a means for readily connecting adjacent beams together whereby one beam may be cantilevered from an adjacent beam when utilizing a special type connecting device, as more fully disclosed hereinafter. Another advantage of the subject modular concrete beam is that the labyrinth of passageways extending within each beam provides inherent insulating properties because of the dead air space within the modular concrete beam. This dead air space also provides the advantage of inherent sound deadening properties for a concrete building constructed utilizing the modular concrete beams 10. These and other advantages will be further discussed with respect to FIGS. 8 through 20.

Figure 4:
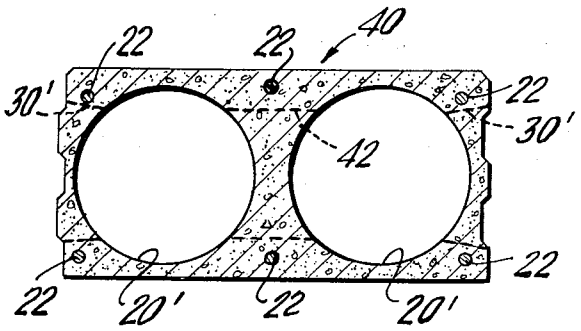
FIG. 4 is a cross-sectional view of a second embodiment of the modular concrete beam of the subject invention.

FIG. 4 illustrates an alternate embodiment of a modular concrete beam and in particular a concrete beam 40, which is generally rectangular in cross-section and has two parallel, longitudinally extending apertures 20′ 20′ extending therethrough. As in the embodiment of FIGS. 1 through 3, the modular concrete beam 40 also includes opposed tapered round holes 30′ in the opposed sidewalls of the beam 40, as well as a corresponding plurality of round holes 42 extending through the central web separating the apertures 20′, 20′. The provision of the apertures 20′, 20′, as well as the tapered round holes 30′ and 42 provide a labyrinth of internal passageways within the modular concrete beam 40 to achieve the advantages of low dead weight of the beam, passageways for enabling the routing of service lines, and dead air space for achieving inherent insulation and sound deadening characteristics of the modular concrete beam. In certain applications, where the modular concrete beam 40 is employed in the construction of a building structure, it may not be necessary to construct all of the modular concrete beams 40 with the holes 42 where service lines are not required to be routed through that portion of the building, in which case the central web would remain as a solid unit in order to provide additional structural rigidity to the modular concrete beam 40.

Figure 5:
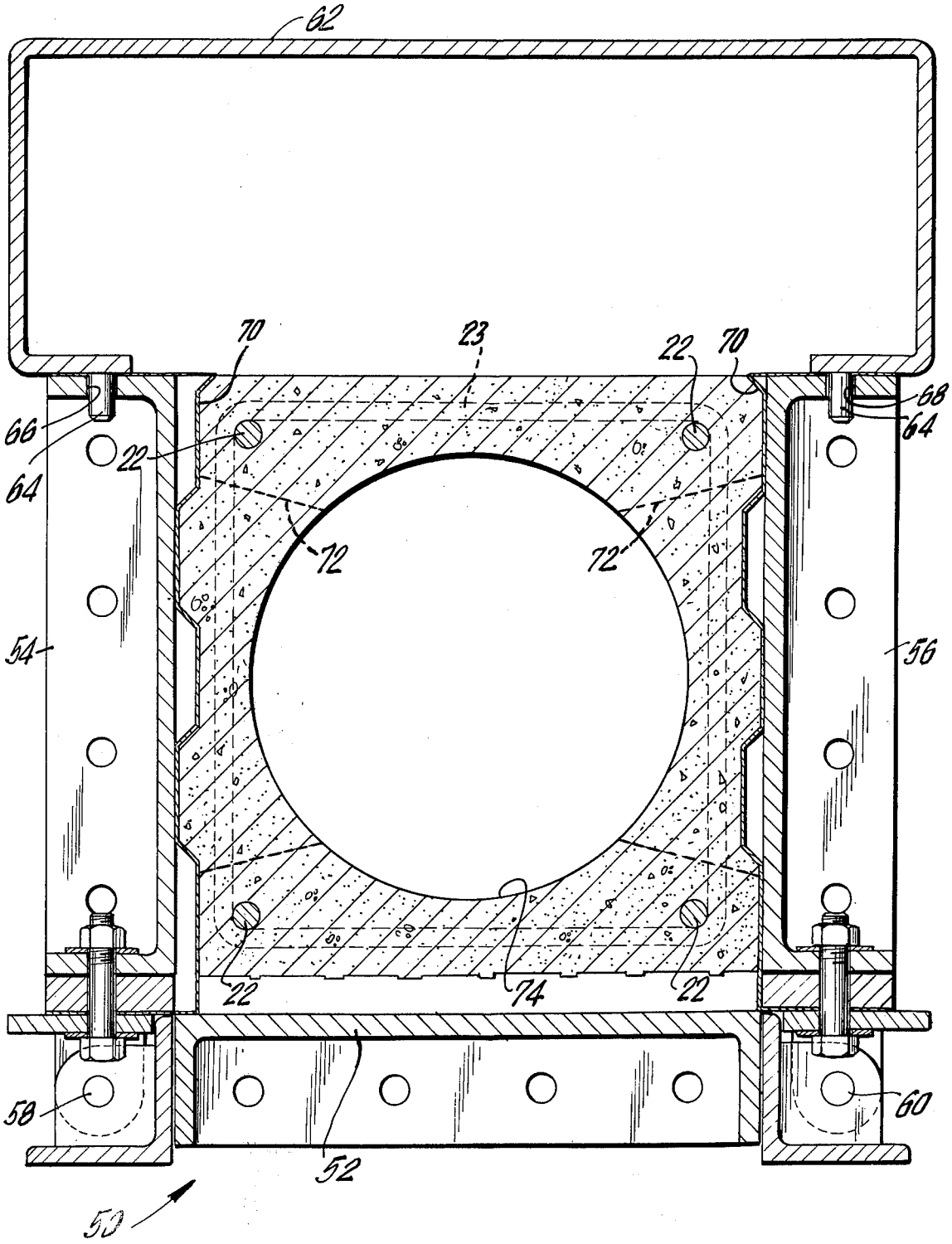
FIG. 5 is a cross-sectional view of a molding apparatus for forming the modular concrete beam of the subject invention.

FIG. 5 illustrates a cross-section of molding apparatus 50 for forming the embodiment of the modular concrete beam 10 illustrated in FIGS. 1–3. The mold apparatus 50 basically comprises an elongated base plate 52 corresponding to the length of the modular concrete beam, two channel-shaped side forming surfaces 54 and 56 which are pivotally connected to said base plate 52 by pivots 58 and 60, respectfully, and a top bracing member 62 having projections 64 that cooperate with apertures 66 and 68, respectively, in the side forming surfaces. Each side forming surface includes a sheet metal member 70 that is configured to conform to the tongue and groove arrangement of the resulting beam, as well as the beveled corners 28 of the resulting modular concrete beam 10. Secured to each sheet metal member 70 of the associated side forming surfaces 54 and 56 are a plurality of truncated cone shaped metallic forming devices 72 that extend toward the interior of the mold in order to cooperate with a mandral 74 which is disposed along the center the mold apparatus 50 for formation of the central longitudinal aperture 20 of the concrete beam. As is readily apparent, the truncated cone shaped devices 72 cooperate with the central mandral 74, in order to define the tapered, round holes 30 in the resulting beam. The mandral 74 may be formed of an inflatable flexible member. As shown in FIG. 5, in addition to the longitudinally extending reinforcing bars 22 at each corner of the modular concrete beam 10, additional reinforcing bar members in the form of an element 23 may be provided in the beam intermediate the locations of the round holes 30.

During a forming operation, the side forming surfaces 54 and 56 are positioned in a generally upright position whereby the projections 64 of the top bracing member 62 are positioned in the respective holes 66 and 68 of the side forming surfaces 54 and 56. The central mandral 74 is positioned or inflated, depending on its construction, and the reinforcing bars 22 and 23 are fixed in place. Concrete is then poured in through the upper portion of the mold apparatus 50, and either tamped or vibrated into place so as to be level with the top of the respective side forming surfaces 54 and 56. After the concrete has cured, the central mandral is deflated and withdrawn, and the top bracing member 62 removed from its engagement with the side surfaces 54 and 56, and the latter are pivoted about the pivots 58 and 60, thereby releasing the resulting modular concrete beam from the mold apparatus 50. Because of the fact that each modular concrete beam is configured so as to be capable of being carried by manual labor, it is readily apparent that the molding apparatus 50 may be delivered to a job site and the modular concrete beams made at the job site, at the same time that concrete buildings are constructed. Furthermore, considering the relative light weight of the modular concrete beams, there is no necessity for heavy construction equipment, nor is there any requirement for a large prefabrication factory in order to make the modular concrete beams.

Figure 6:
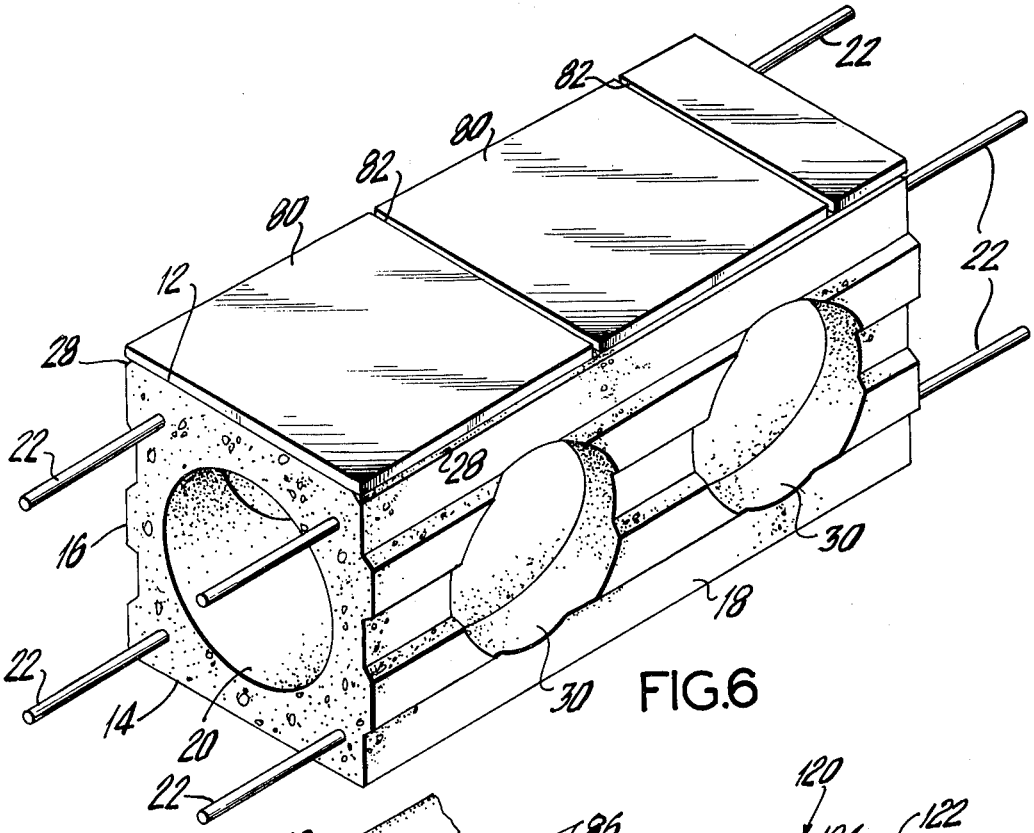
FIG. 6 is a perspective view of a portion of an embodiment of the modular concrete beam of the subject invention.

Referring now to FIG. 6, another embodiment of the subject modular concrete beam comprises the basic construction of an elongated concrete beam having a longitudinal aperture 20 and a plurality of tapered round holes 30 extending transverse to the longitudinal axis of the beam, and formed integral with the beam along the top surface 12 thereof is an architectural finish in the form of tile 80. The latter may be a ceramic or similar type tile 80 which is separated by grouting material 82 along the entire length of the upper surface 12 of the modular concrete beam. The finish material 80 is formed with the modular concrete beam so as to result in an integral construction whereby the resulting modular concrete beam has two opposed sides that are configured to have a tongue and groove arrangement, a lower surface of smooth concrete finish, and an upper surface that is architecturally finished in a different material, such as ceramic tile, slate tile, or the like. As is readily apparent, the modular concrete beam of FIG. 6 may be employed as the floor of a concrete building structure, and in addition, may also be employed as either the ceiling or the exterior of a roof of a concrete building structure.

Figure 7:
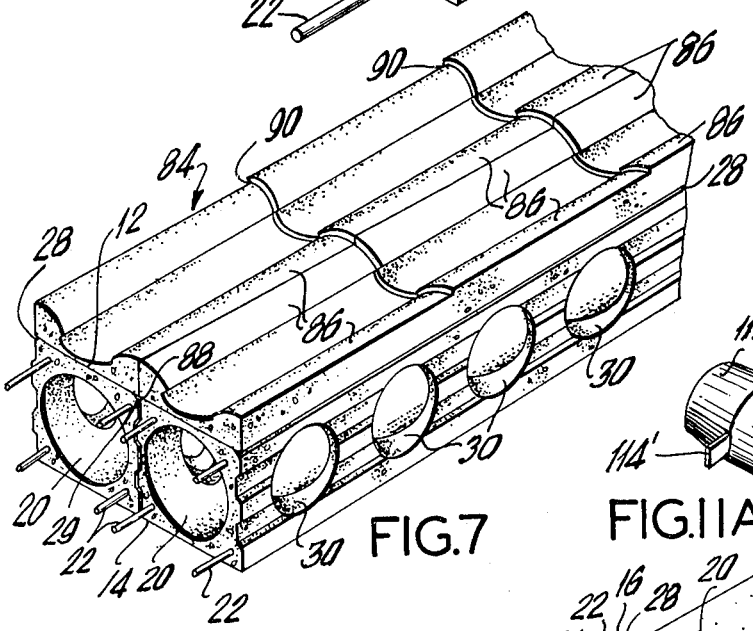
FIG. 7 is another perspective view of portions of several interconnected modular concrete beams of the subject invention.

FIG. 7 illustrates still another embodiment of the subject modular concrete beam, in which the top surface 12 of the beam has integrally formed therewith an imitation Spanish roof tile sections are joined, with the beveled corners 28 of adjacent beams, cooperating to define a groove 88, into which suitable sealing material 29 is placed. The cooperation between the tongue and groove arrangements of adjacent modular concrete beams is clearly illustrated in FIG. 7, and this figure also illustrates how the transverse holes 30 of adjacent beams are aligned thereby forming a true labyrinth of interconnected passageways between adjacent beams. Furthermore, as shown in FIG. 7, the imitation Spanish roof tile configuration of the beams is stepped as at 90 whereby when the modular concrete beams are joined to form a pitched roof of a building structure, the stepped arrangement assists in the continual wash-off of water from the roof.

Although only several different embodiments of the finished top surface of a modular concrete beam 10 of the subject invention have been illustrated, it is readily apparent that the top surface 12, and/or the bottom surface 14 of each beam may be configured so as to result in an integral architectural finish, either in the form of the several embodiments illustrated, or other known forms such as hand split wood shakes, overlapping slate tile, imitation asphalt shingles, adobe brick or any other design desired.

Figures 8, 9:
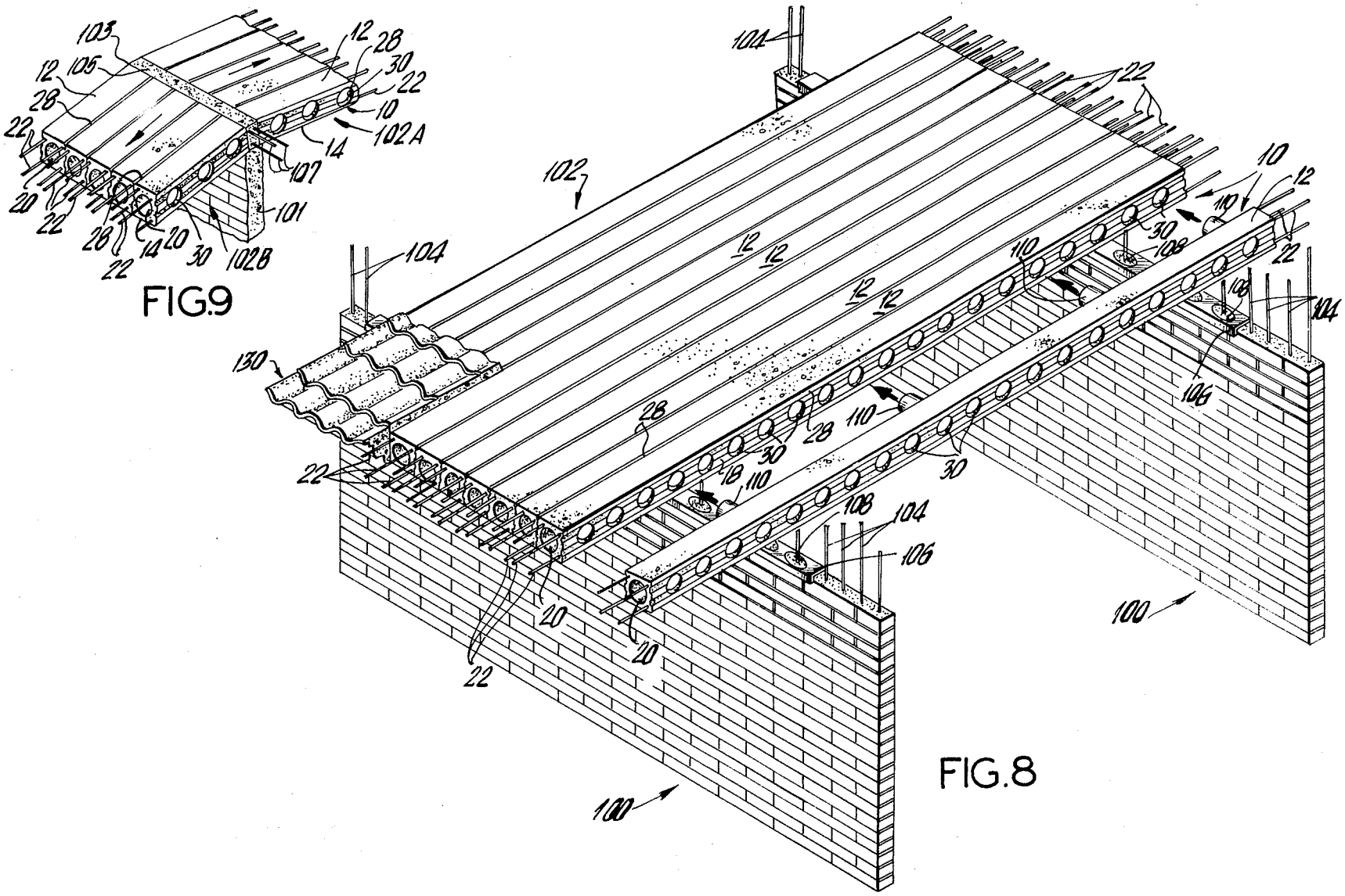
FIG. 8 is a perspective view of a portion of a building structure having conventional walls and a roof structure made according to the method of the subject invention and utilizing modular concrete beams.
FIG. 9 is a perspective view of a portion of a roof made utilizing the subject modular concrete beams, which roof is pitched along a portion thereof.

FIG. 8 illustrates the construction of a one story building structure having conventional walls 100 and a roof structure 102 made utilizing the modular concrete beams 10 of the subject invention. As shown in FIG. 8, the walls 100 are of conventional brick construction, or alternatively, may be formed by a cast-in-place technique wherein metallic forms are used having a brick pattern. The metallic forms are interconnected in spaced relationship, after which concrete is poured between them. After the concrete has cured to a sufficient degree, the wall forms are removed, thereby leaving the walls 100. Disposed within and embedded in the walls 100 are a plurality of reinforcing bars 104. In the construction of the one story building structure shown in FIG. 8, the reinforcing bars 104 extend above the top level of the brick wall 100, and a channel shaped metallic cap 106, having elliptically shaped openings 108 is placed over each wall 100. The bars extend through the openings 108 and also through suitable holes cut into the lower surface 14 of the beams, and rigidly connected to the beams by concrete or other adhesive. In order to achieve a pitched roof, one of the walls 100 should be constructed to be slightly greater in height than the other wall. The modular concrete beams 10 may be of the type illustrated in FIG. 7, as comprising an imitation Spanish tile roof, and the modular concrete beams are sequentially placed to span the space intermediate the walls 100. Abutting modular concrete beams 10 are interfitted in their tongue and groove slots, and suitable means, such as concrete or other adhesive, or a bolting arrangement, as hereinafter described with reference to FIG. 16 may be employed for rigidly connecting each beam to the conventional walls 100. In addition to the inherent strength achieved by the interlocking arrangement of the abutting modular concrete beams, means are provided for additionally strengthening the load carrying capability of the modular concrete beam 10 in the form of lateral connecting members, designated by numeral 110.

Figure 11A:
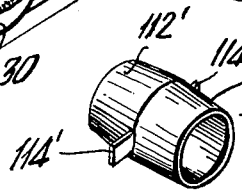
FIG. 11A is an alternate embodiment of a connector device.
Figure 11:
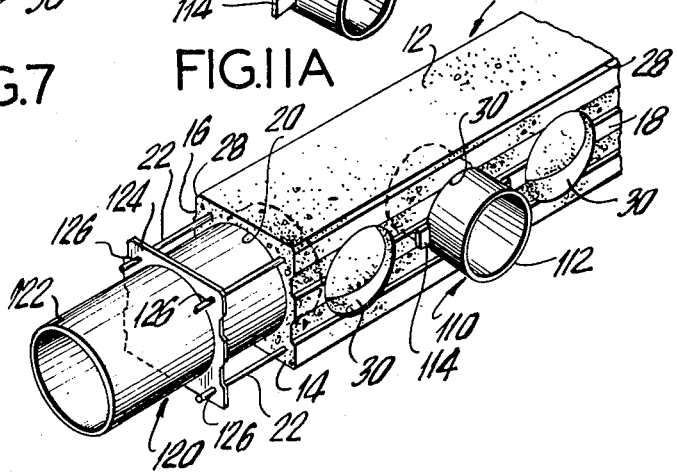
FIG. 11 is a perspective view of several connector devices employed in combination with a modular concrete beam of the subject invention.

Referring to FIG. 11, a lateral connecting member 110 comprises a tubular metallic member 112 having, intermediate its length, two external flanges 114. The diameter of the tubular member 110 corresponds to the diameter of the transverse round holes 30 in the modular concrete beams 10. As shown in FIG. 8, one end of a lateral connecting member 110 is shoved into a transverse round hole 30 of the next modular concrete beam 10 to be secured to the roof structure 102, and the beam 10 is then shoved into place, whereby the opposite end of the respective lateral connecting member 110 is forced into the associated transverse round hole 30 of the abutting beam. It is noted that the portion of the lateral connecting means 110, which is inserted into the modular concrete beam, is less than the diameter of the longitudinal aperture 20 so as to not obstruct the latter aperture whereby it may still be used as a conduit for the routing of service lines. Accordingly, the flanges 114 assure the correct positioning of the connecting means within the associated modular concrete beams 10. As mentioned above, in addition to the beam reinforcing effect achieved by means of the tongue and groove association of adjacent abutting modular concrete beams 10, the lateral connecting members 110 further provide reinforcing means for preventing deflection of the roof structure 102, and also aid in maintaining proper alignment of abutting modular concrete beams.

Figure 10:
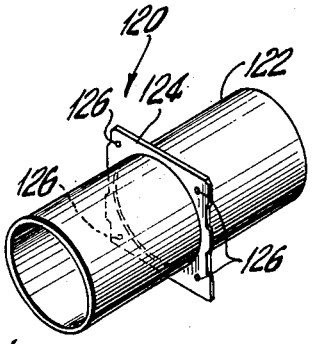
FIG. 10 is a perspective view of a connecting device for interconnecting abutting modular concrete beams of the subject invention.

Another form of connecting means is illustrated in FIGS. 10 and 11, as comprising a longitudinal connecting means 120 comprising a tubular metallic member 122 having, aboutt the periphery of its midpoint, a plate 124, including four spaced holes 126, that are substantially aligned with reinforcing bars 22 extending from the modular concrete beam. As shown in FIG. 11, the diameter of the tubular member 122 corresponds to the diameter of the longitudinal aperture 20, whereby, the longitudinal connecting means 120 may be readily inserted into the longitudinal aperture 20 of a concrete beam, with the reinforcing bars 22 extending through the apertures 126 of plate 124. The longitudinal connecting means 120, as well as the lateral connecting means 110, are preferably of integral construction, and made of a suitable metallic material which has substantial strength for reinforcing purposes.

Referring to FIG. 11A, a second embodiment of the lateral connector device is designated 110' and includes tapered tubular sections 112' adopted to be received into the tapered transverse holes 30 in order to achieve a greater wedge or friction fit, with flanges 114' also being provided to limit the degree of insertion of the device 110' into the respective opening 30.

In order to finish off the end of the roof structure 102 made by the assembly of modular concrete beams 10, suitable fascia members 130 may be provided and include suitable connecting means so as to be connected to the reinforcing bars 22 extending from the exposed ends of the modular concrete beams 10.

FIG. 9 illustrates a modification of a roof structure made utilizing the modular concrete beams of the subject invention, wherein, in addition to two exterior upstanding walls (not shown), the building includes a central upstanding wall 101 of conventional construction, which is higher than the two exterior walls. The roof structure comprises a gable type roof formed by two assemblies 102A and 102B of interconnected modular concrete beams 10, each of which extends between the central wall 101 of the building, and the respective exterior wall (not shown). The V-shaped groove 103 defined at the ridge of the roof may be readily filled in with concrete material 105 and reinforcing bars 107, after the roof structures are assembled.

Figure 12:
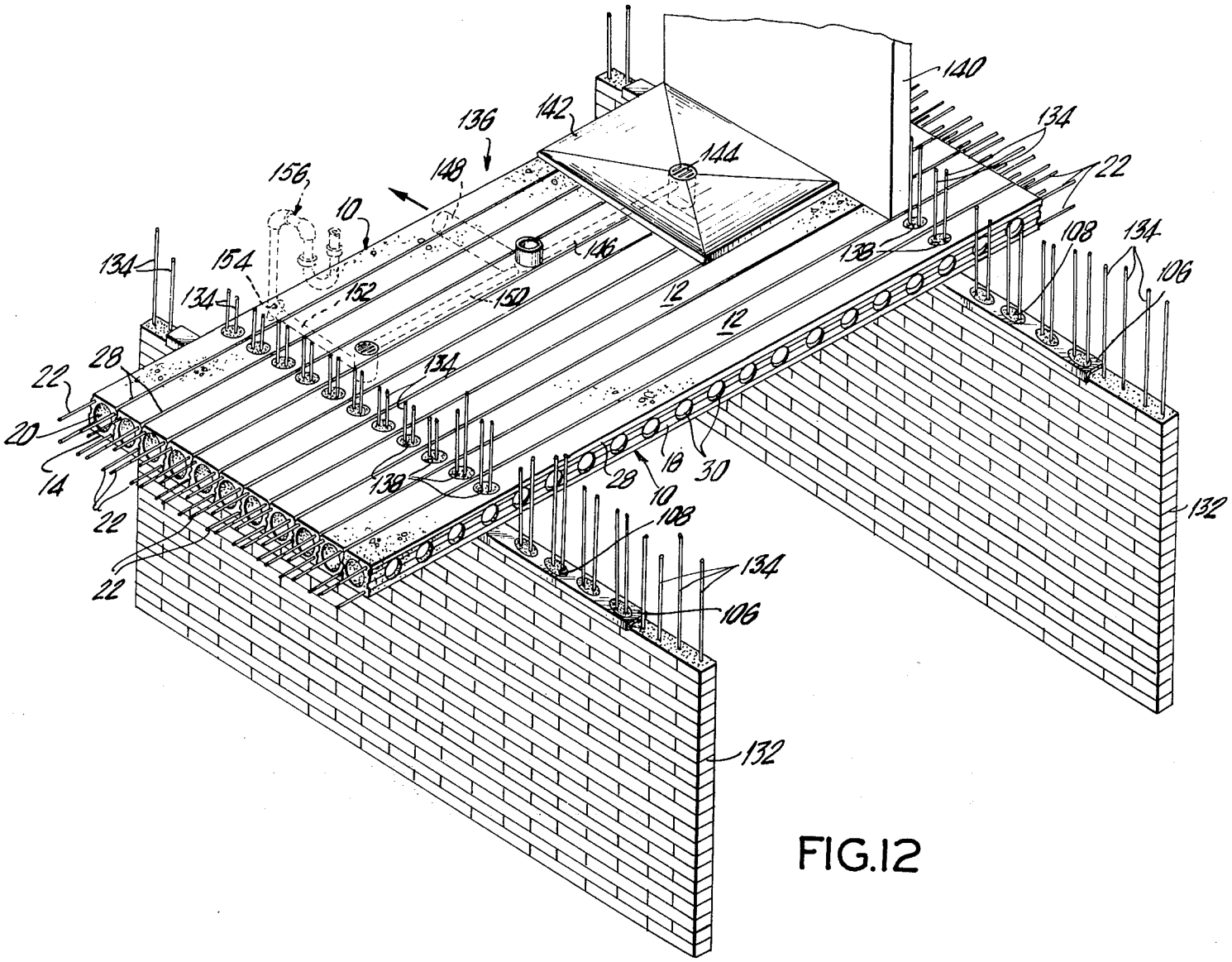
FIG. 12 is a perspective view of a building structure, including plumbing lines extending through the floor of a multistoried structure made utilizing the modular concrete beams of the subject invention.
Figure 13:
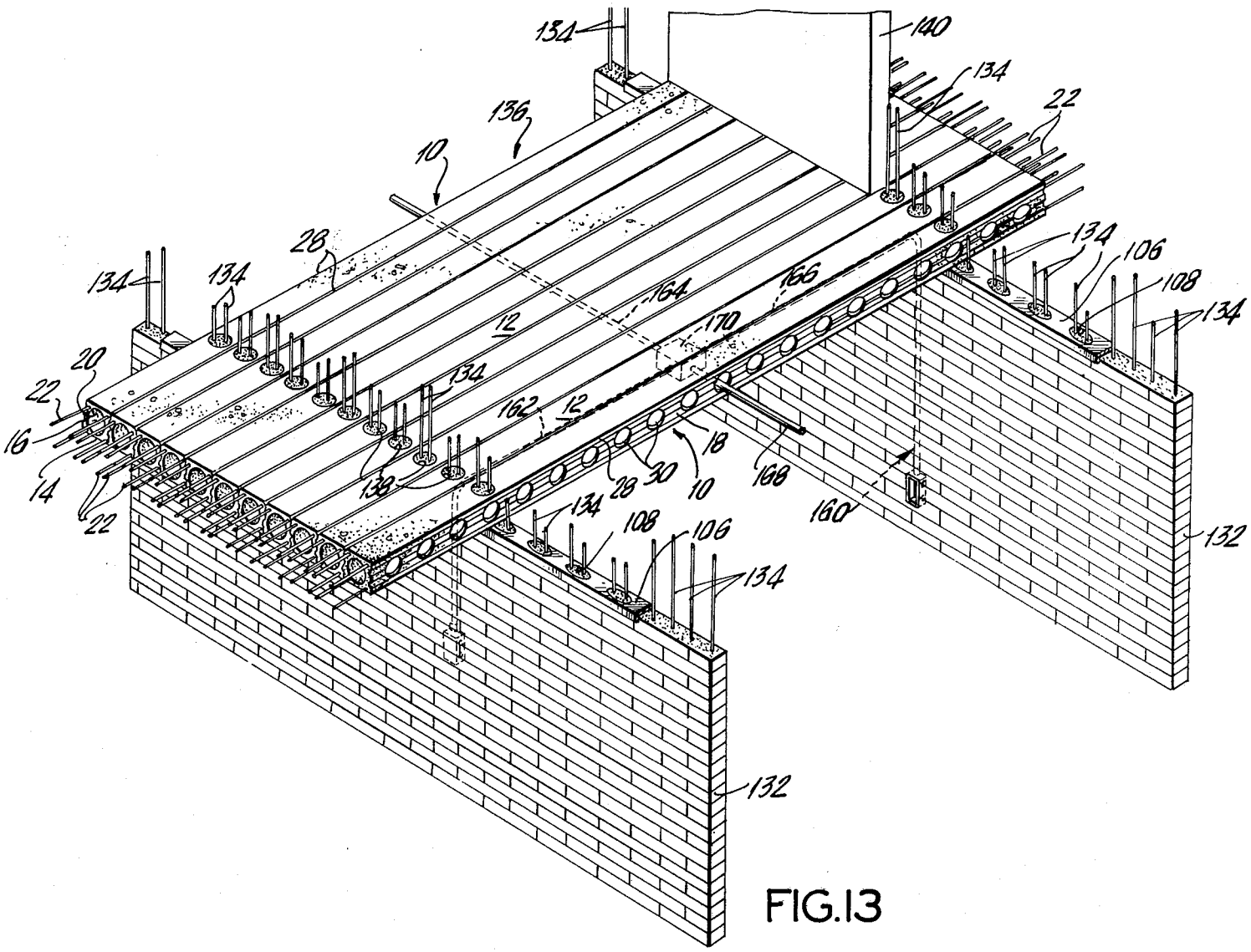
FIG. 13 is similar to FIG. 12, but illustrating the placement of electrical lines extending through a concrete building structure.

FIGS. 12 and 13 illustrate another embodiment of a building structure made according to the teaching of the subject invention, with FIG. 12 illustrating the layout of the plumbing lines extending through the first floor of the multi-story building, while FIG. 13 illustrates the layout of the electrical conduits of the multi-story building.

Referring to FIGS. 12 and 13, the upstanding exterior walls 132 are made by conventional construction techniques, and include reinforcing bars 134 which are not sheared off at the top of the first floor, but extend through the elliptical openings 108 in the metallic cap 106 extending along each conventional wall 132. Since the first floor is to be level, the conventional walls 132 are of equal height, and the first floor 136 is formed by interconnecting a plurality of modular concrete beams 10 that are slightly modified in that holes 138 are cut into the top surface 12 and the bottom surface 14 of the beams to enable the reinforcing bars 134 to pass therethrough. Accordingly, when the walls of the second floor, designated by numeral 140 are constructed, the reinforcing bars 134 are embedded therein, thereby forming a rigid interconnection between the lower conventional walls 132, the floor structure 136, and the walls 140 of the second floor of the multi-story building. Concrete is preferably filled into the modular concrete beams in the region of holes 138 where the reinforcing bars 134 pass through in order to assure a rigid interconnection for the structure. Referring to FIG. 12, the plumbing lines for a bathroom are illustrated, and in particular a shower base plate 142 is connected to a drain 144, with the drain pipe 146 extending through the longitudinal aperture 20 in one of the modular concrete beams 10, at a suitable position where it is connected to a sewer line 148, that extends transversely of the adjacent modular concrete beams, and in so doing, extends through the lateral round holes 30 of adjacent beams. Still further, other pipes 150, 152 are shown as extending within the floor constructed of the abutting modular concrete beams 10, and, where necessary, openings 154 are cut into the modular concrete beams in order to enable the necessary plumbing pipes, designated by 156, to extend above the floor. As clearly illustrated in FIG. 12, all of the interconnecting plumbing may be readily accomodated with the labyrinth of interconnecting passageways formed by the floor 136 made of the modular concrete beams of the subject invention. In addition, there is a great number of additional passageways that may be utilized for other service lines, such as water feed pipes, gas lines, etc.

FIG. 13 illustrates the ducting of the electrical conduits through the respective longitudinal apertures 20 and lateral round holes 30 of the abutting modular concrete beams. It is noted that, as shown in FIG. 13, it is also possible to duct the electrical conduits within a solid conventional wall 132, and of course for this purpose, the electrical conduits 160 must be embedded within the concrete at the time of construction. Accordingly, because of the embedding of the electrical 160 conduit within the conventional walls, it is virtually impossible to rearrange the electrical conduits, if this is desired at a later date. This limitation is not present in the floor structure 136 made utilizing the modular concrete beams 10 of the subject invention, in that at any time, the electrical, plumbing, gas, or other lines may be rerouted without destroying the walls, floors, or roof made utilizing the modular concrete beams of the subject invention. As shown in FIG. 13, the electrical conduit 162–168 may extend in any lateral or longitudinal direction from the junction box 170 within the internal passageway of floor 136.

Figure 14:
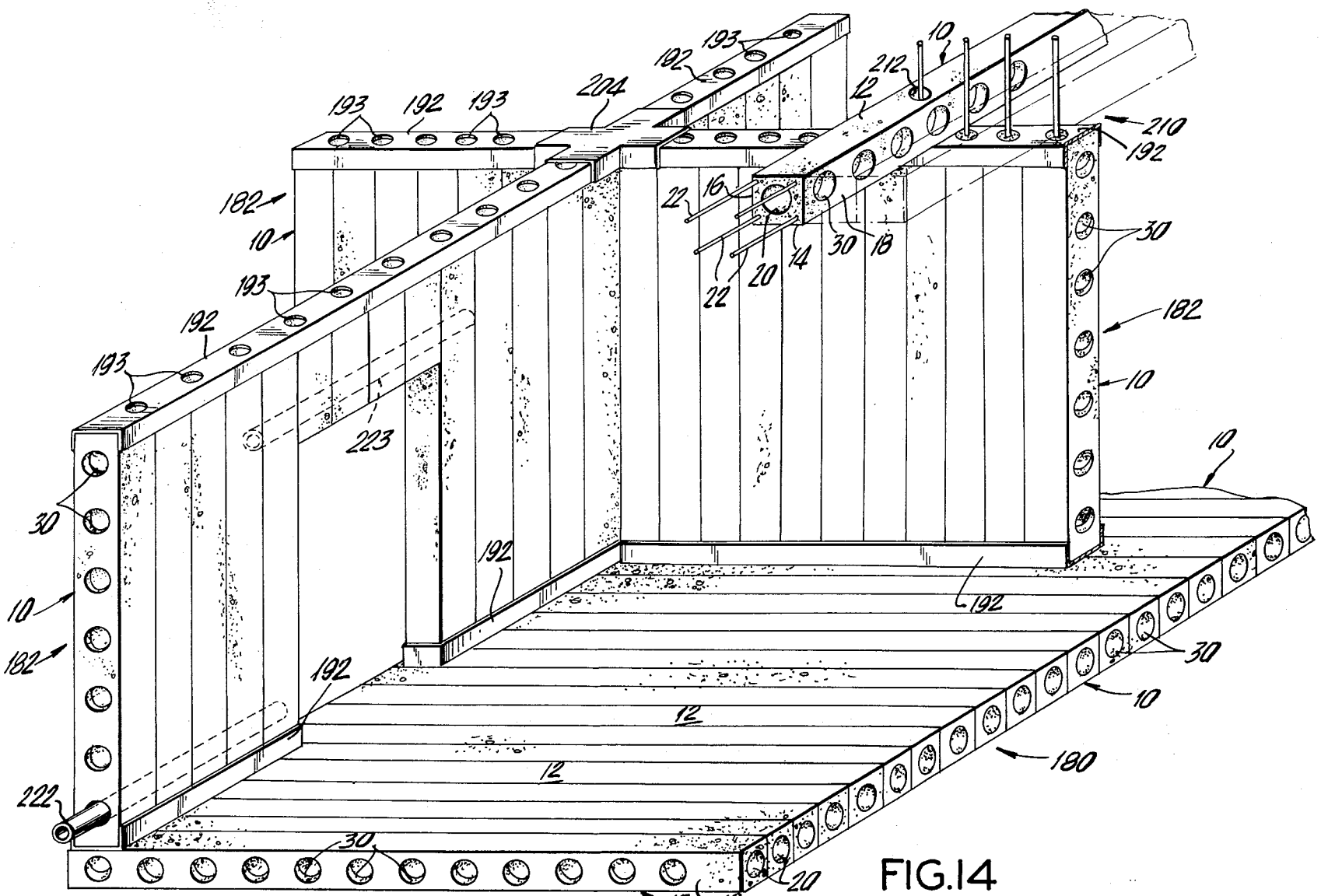
FIG. 14 is a perspective view of a portion of a concrete structure made according to the teachings of the invention.
Figure 15:
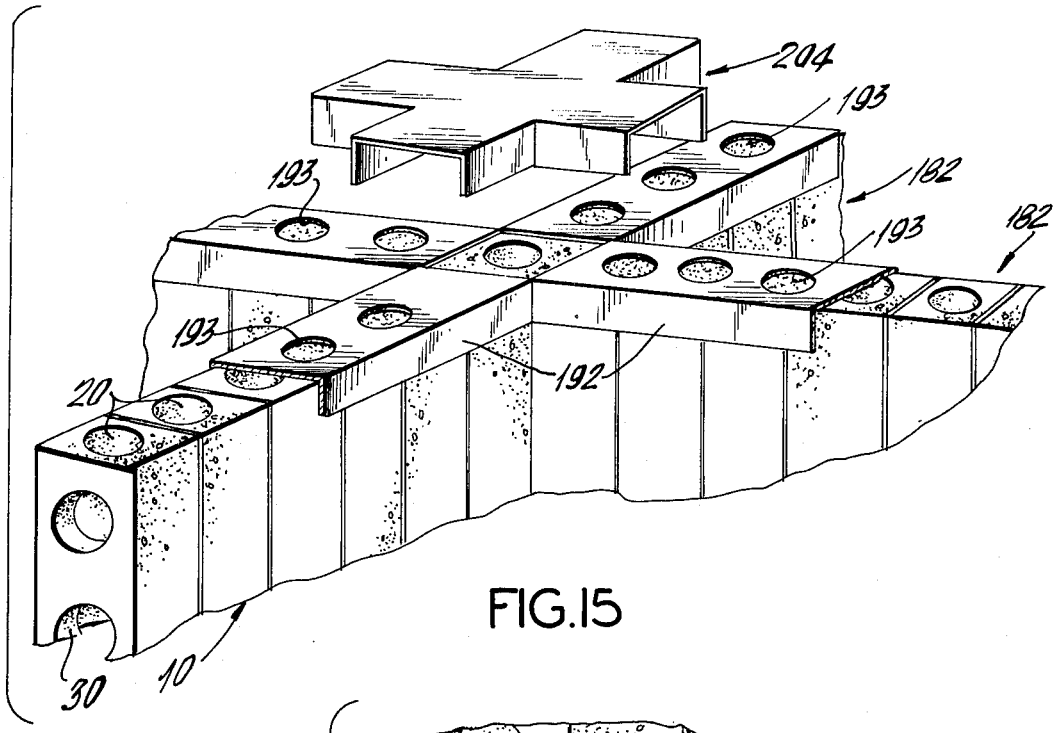
FIG. 15 is a partial perspective view of a portion of the building structure of FIG. 14.
Figure 16:
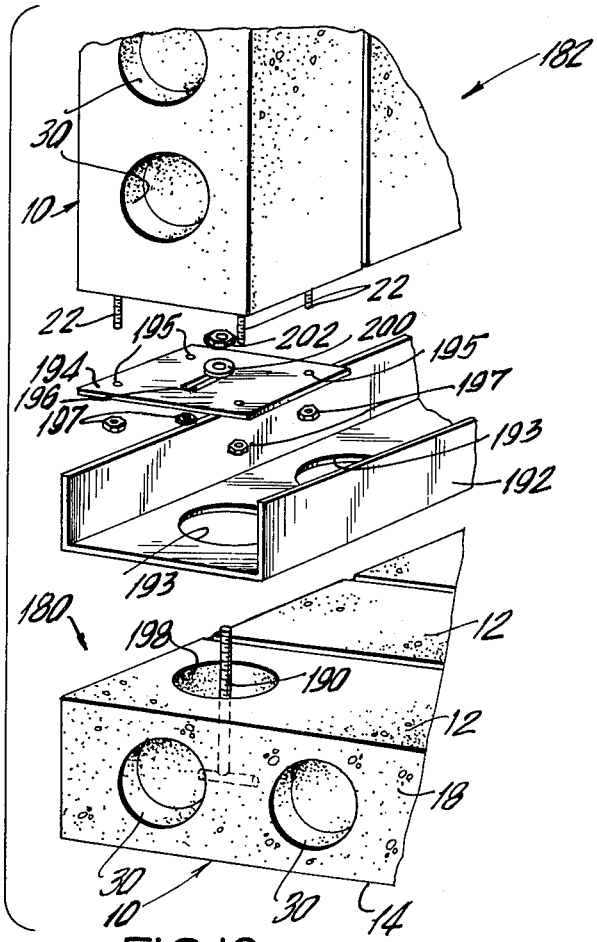
FIG. 16 is an exploded perspective view of the interconnection between the floor and the upstanding walls of the building structure of FIG. 14.

FIGS. 14 through 16 illustrate a concrete structure of the subject invention employing modular concrete beams 10 for the floor or foundation, the upstanding walls, both interior and exterior, and the roof of a structure. More particularly, referring to FIG. 14, the foundation 180 of the concrete building is formed by interconnecting a plurality of modular concrete beams 10. Of course, prior to the interconnection of the modular concrete beams, the site of the building structure is appropriately leveled, and if necessary, a footing or basement type foundation is prepared. The modular concrete beams are positioned to span the respective footing or foundation, and are interconnected by their tongue and groove arrangement, as well as by means of lateral connectors 110, of the type illustrated in FIGS. 11 or 11A. In addition, if desired, additional reinforcing means may be extended transversely to the length of the beams, which reinforcement (not shown) passes through the transverse round holes 30 of the abutting beams in order to provide additional reinforcement to the foundation 180.

Referring to FIG. 16, in order to provide a rigid interconnection between the foundation 180 and the upstanding interior or exterior walls, designated by numeral 182 in FIG. 14, a tie down arrangement is provided. As shown in FIG. 16, one possible form of tie down arrangement may comprise the combination of a T-shaped bolt 190, a channel shaped reinforcing member 192, and a slotted plate 194. Firstly, a cut-out 198 is provided at a designated location in a modular concrete beam, after which the T-shaped bolt 190 is inserted through the cut-out 198 and concrete is poured into the cut-out in order to form a rigid connection between the T-shaped bolt 190 and the modular concrete beam. After a plurality of such bolts 190 are fixed within the foundation 180, the channel shaped reinforcing member 192 having openings 193 therein, is positioned over the bolts 190. Next, the slotted plate 194, which includes a plurality of apertures 195, that are aligned with the reinforcing bars 22 of the modular concrete beam, as well as an elongated slot 196 therein, is secured by means of nuts 197 to said reinforcing bars 22. Next, the modular concrete beam of the wall 182, with the attached plate 194 is positioned into the channel 192, with the end of the bolt 190 extending through the slot 196. By access through the round hole 30, along with the elongated aperture (not shown) of the modular concrete beam 10, the construction worker is able to secure a washer 200 and nut 202 to the T-shaped bolt 190, thereby forming a rigid connection between the wall 182 and the modular concrete beam of the foundation 180.

As shown in FIG. 14, the use of channel member 192, in addition to functioning for tieing down the walls 182 to the foundation 180, also provides means for assuring alignment of the vertically extending longitudinally concrete beams 10 of the walls. In like manner, U-shaped channel members 192 are provided along the upper end of the interconnected modular beams 10 of the walls 182, to ensure alignment of the latter.

At the intersection of upstanding walls, as shown in FIGS. 14 and 15, preferably a cross-shaped member 204 is provided, having a U-shaped cross-section so as to engage the two intersecting walls, in order to ensure alignment, as well as to provide reinforcing to the upstanding concrete walls. The roof, partly shown, and designated by numeral 210 is of the similar construction, as shown by the roof structures of FIGS. 12 and 13, as comprising a plurality of interconnected modular concrete beams. When a two story building construction is to be constructed, suitable cut-outs 212 are provided in the modular concrete beams in order to enable the reinforcing bars to extend through the beams, thereby forming a rigid interconnection between the first and second stories of the concrete structure.

As shown in FIG. 14, in order to provide additional reinforcement to the structure of the upstanding walls, suitable reinforcing members may be provided, either of the type designated at 222, which extends through the wall 182 adjacent the lower end thereof, or, as shown at 223, across an opening such as a doorway to act as a header, as well as to support the shorter lengths of modular concrete beams above the door opening. As is readily apparent, variable lengths of modular concrete beams may be employed for defining the other required openings in a building structure, such as the windows and doorways of the structure.

Figures 17, 18, 19, 20:
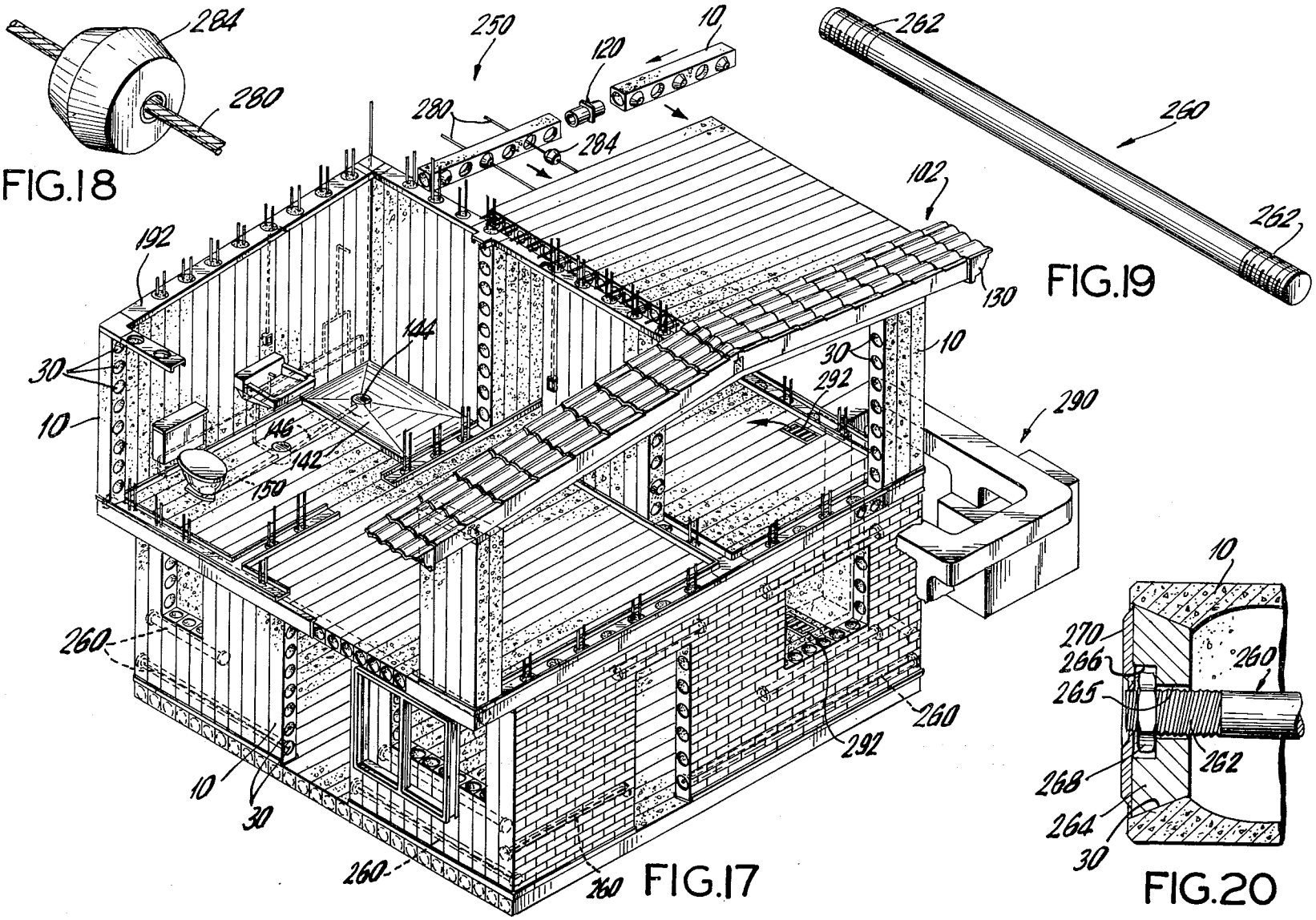
FIG. 17 is a perspective view of a two-story concrete structure made according to the teachings of the subject invention.
FIG. 18 is a perspective view of a joining element for the modular concrete beams.
FIG. 19 is a perspective view of a reinforcing rod used to interconnect several modular concrete beams.
FIG. 20 is a partial sectional view of the end connection of a reinforcing rod to a modular concrete beam.

Turning to FIG. 17, a two-story concrete structure, more particularly, a house 250 is illustrated as comprising foundation, first and second story upstanding walls (both interior and exterior), and roof, all constructed by interconnecting a plurality of modular concrete beams 10, as described hereinabove. The various accessory elements employed in the construction of house 250 are identified by the same numerals previously designated with reference to other FIGS. in this disclosure. In addition, for purposes of tying together or reinforcing the modular concrete beams or columns forming the upstanding walls, tie rods 260 (see FIG. 19) are provided, each of which is a metallic member of high tensile strength and threaded at each end thereof, as designated at 262. As shown in FIG. 17, the tie rods 260 extend through the aligned lateral holes 30 abutting concrete beams 10, and terminate by connection to specially shaped block members 264 (see FIG. 20) that are suitably tapered to be received in the tapered lateral hole 30 at the face of the upstanding wall. Block 264 includes a central opening 265 having an enlarged section 266. A nut 268 is received in enlarged section 266 for engaging the threaded section of tie rod 260. After the tie rod and block member 264 are assembled, a suitable decorative member 270 may be placed over the end of the connection for aesthetic purposes. A similar termination assembly may be utilized for the cable rod reinforcing means 280 provided for the roof structure made employing the subject modular concrete beams. In addition, referring to FIGS. 17 and 18, roof reinforcing cables 280 extend through lateral openings 30 in abutting concrete beams 10 and have mounted thereon doubly tapered lateral reinforcing elements 284 that are adapted to be received in the respective lateral openings 30.

As also shown in FIG. 17, the house 250 is constructed such that the various service lines, e.g. plumbing, electricity, sewage, etc., extend through the labyrinth of passageways in the abutting modular concrete beams. Furthermore, this labyrinth of passageways provides the conduits through which air (whether heated or air conditioned) may be passed from a central unit, designated by numeral 290, to various registers 292 in the house.

Figure 21:
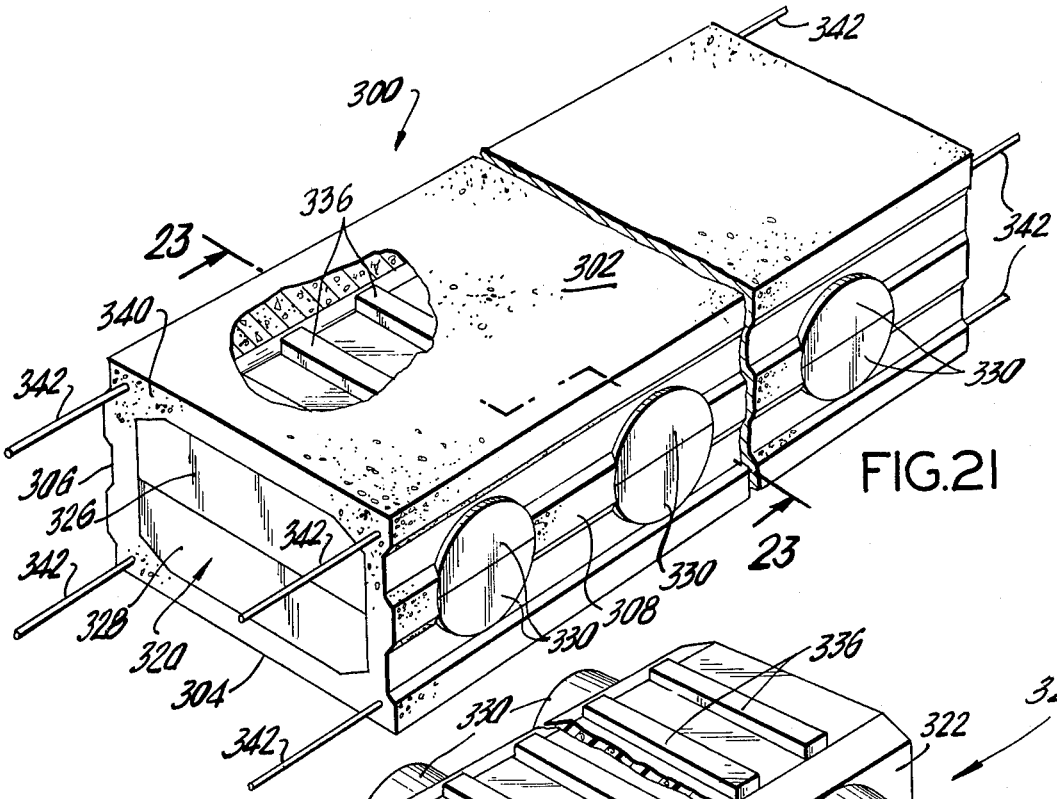
FIG. 21 is a perspective view of another embodiment of a modular concrete beam of the subject invention including the composite arrangement of an inner hollow polystyrene mold and an outer concrete shell.
Figure 22:
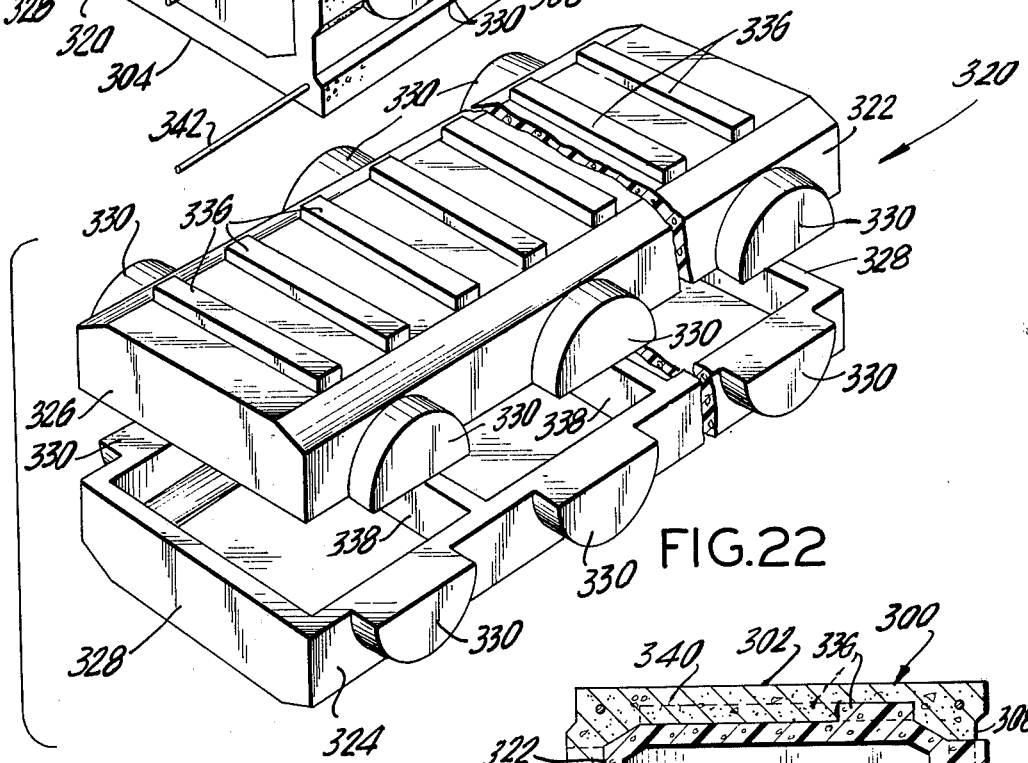
FIG. 22 is an exploded perspective view of the inner polystyrene mold of the modular concrete beam illustrated in FIG. 21.
Figure 23:
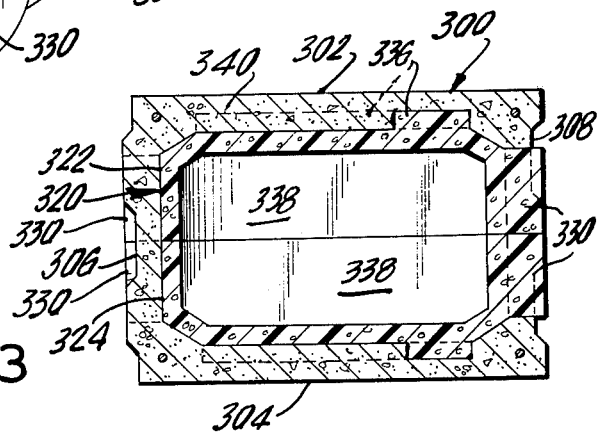
FIG. 23 is a sectional view taken along line 23—23 in FIG. 22.

FIGS. 21 through 23 illustrate another embodiment of the subject modular concrete beam, designated by the numeral 300. Modular concrete beam 300 comprises an elongated composite structure of generally rectangular cross-section having a top surface 302, a bottom surface 304 and opposed side surfaces 306, 308. As in the configuration of beam 10 (see FIGS. 1–3), the opposed side surfaces 306, 308 have a cooperating tongue and groove configuration, while either one or both of the top 302 and bottom 304 surfaces may be architecturally finished as required.

Beam 300 comprises the composite arrangement of an internal, hollow mold 320, and an external concrete structure 340 extending about and in intimate contact with mold 320.

Turning to FIG. 22, the frangible mold 320 is preferably made of a plastic material (i.e., an organic chemical material), and more specifically, a thermoplastic material such as polystyrene which has the desirable characteristics of: extremely light weight; good dimensional stability; excellent moisture and humidity resistance; good insulation properties; and frangible. Of course, other forms of plastics, such as thermosetting materials may also be employed. Referring to FIG. 22, frangible mold 320 is elongated and of generally rectangular cross-section to correspond to the configuration of beam 300, and may be formed of two mating sections 322 and 324 that are hollow. The opposite ends of each section 322, 324 are closed by end baffles 326, 328, respectively, whereby, when fully assembled, the frangible mold 320 defines an elongated hollow member for the composite frangible beam 320. In addition, the latter includes a plurality of spaced projections 330 disposed along the longitudinal sides thereof, which projections are generally annular in configuration and are of a thickness equal to or slightly greater than the thickness of the external concrete structure 340, as more fully discussed below. As shown in FIG. 22, one-half of each projection is formed on each of the mating sections 322 and 324.

In order to save concrete and reduce material cost, without significantly reducing the structural capability of the modular concrete beam 300, the frangible mold 320 may be provided with a plurality of elongated, spaced projections 326 disposed along the top and/or the bottom of the frangible mold 320.

As also shown in FIG. 22, the frangible mold 320 may be provided with a series of spaced, intermediate baffles 338 which are preferably disposed between the locations of the projections 330. Spaced baffles 338 will function to confine concrete in a limited area of the hollow beam 300, when, for example, the frangible end baffles 326, 328 are knocked out of beam 300, and it is desired to permanently secure (by concrete) a bolt to the beam 300 for interconnecting two walls made of the modular concrete beams, as described hereinabove with respect to FIGS. 14–17. In effect, the internal, aligned baffles 338 function to subdivide the hollow mold 320 into a series of compartments.

Turning to FIGS. 21 and 23, as illustrated the external concrete structure 340 of the composite beam 300 extends about and is in intimate contact with the internal, frangible mold 320, with only the frangible opposite end baffles 326, 328 and the frangible projections 330 being exposed. Disposed at each corner of the concrete structure 340 are reinforcing bars 342 that extend along the length of the beam 300.

In order to manufacture beam 300, two mating sections 322 and 324 of a frangible mold 320 are suitably secured together and placed in a suitable apparatus (of the type described with reference to FIG. 5 but, of course, without the central mandral or the tapered cone devices), along with the reinforcing bars, after which concrete is poured into the apparatus to form the composite beam. The frangible projections 330 and the frangible end baffles 326, 328 would bear against the internal surface of the molding apparatus so that such projections and ends would be exposed on the resulting modular concrete beam 300.

Modular concrete beam 300 is employed for the construction of building structures in the same manner as the modular concrete beam 10 described above with respect to FIGS. 1–3, 8–9, and 12–20. Beam 300 may be of varied length, architectural finish, and cross-section as required. Whenever service lines etc. are to be routed through beam 300, the construction worker merely has to remove (e.g. by drilling, punching out, etc.) the necessary frangible projections 330 (thereby creating a lateral hole through the beam) or the frangible end baffles 326, 328 (thereby creating the longitudinal aperture through the beam). In those instances where intermediate baffles 338 are provided, they are also readily removed since they are also made of frangible material such as polystyrene. Accordingly, beam 300 achieves all of the advantages of the basic modular concrete beam 10, and in addition, has several further advantages. For example, the composite construction of beam 300, and in particular, the provision of the internal mold 320, enables the beam 300 to be constructed having a greater cross-sectional area (on the order of one third greater size) than the basic modular beam 10. Secondly, the provision of the internal mold reduces the costs of manufacture since the manufacturing apparatus for beam 300 is simpler than the apparatus illustrated in FIG. 5 for manufacturing beam 10. Other advantages are achieved by the provision of elongated projections 336 (as discussed above) and the intermediate baffles 338. In addition, the provision of the internal frangible mold (which is closed, except where portions are removed for routing of service lines, as required) greatly increases the insulation characteristics and sound deadening characteristics of the beam. The above and many other advantages leading to lower materials and construction costs are achieved by the composite modular concrete beam 300.

Accordingly, the subject invention provides a new and improved modular concrete beam, as well as a new and improved concrete structure and a method of making same. The one-piece modular concrete beam incorporates the desirable and necessary characteristics for a true universal modular concrete beam element that may be readily and rapidly combined in order to result in a complete concrete construction. The modular concrete beam is lightweight, thereby obviating the necessity for heavy construction equipment; is suitably configured, so as to enable the ducting therethrough of the necessary service lines, thereby obviating the necessity for drop ceilings and the like in the resulting building structure; has a tongue and groove configuration so as to insure its rapid assembly by unskilled laborers, thereby obviating the necessity for supervisory personnel and skilled laborers; results in a structure having an inherent "dead air space", thereby providing the desirable characteristics of insulation and sound deadening characteristics; because of the arrangement of openings extending therethrough, provides a labyrinth of interconnected passageways; may be constructed of any architectural finish thereby obviating the need for a finishing operation after the structure is completed; and has many other advantages as fully set forth above.

The concrete structure made according to the teaching of the invention comprises the interconnection of a plurality of such modular concrete beams in order to form the foundation, upstanding walls, and roof, or alternatively, when a conventional foundation and upstanding walls are constructed, such modular concrete beams may be interconnected in order to form the roof of a structure. The concrete structure comprises interconnecting modular concrete beams, utilizing the integral tongue and groove configuration thereof, as well as employing a plurality of lateral connectors and longitudinal connectors, as described with reference to FIGS. 10 and 11. Furthermore, the interconnection between the foundation and walls is of the type illustrated in FIG. 16, comprising a bolt and plate arrangement which cooperates with the reinforcing bars formed integral with the modular concrete beams to achieve a rigid interconnection between the foundation, the walls and the roof structure. Also, as described with reference to FIGS. 15 and 16, channel-shaped members are provided for insuring alignment of the modular concrete beams, as well as providing additional reinforcement for the structure. In addition, at intersections, cross-shaped elements, also having channel-shaped configurations are provided. The resulting concrete structure and the method of making same, may be rapidly achieved at the job site, utilizing unskilled laborers and not requiring heavy construction equipment. In fact, the modular concrete beams can be preformed at the job site, utilizing molding apparatus of the type illustrated in FIG. 5. Because of the specific architectural configuration of the modular concrete beams, the concrete structure may be architecturally finished upon assembly of the modular concrete beams, without resorting to conventional finishing techniques, such as plastering, painting, stone or brick veneering, et cetera. The concrete structure and the method of making same, according to the invention, eliminates the many different kinds of materials and thousands of pieces required for conventional construction, and the one process of interconnecting the modular concrete beams eliminates the multi-process techniques required for conventional construction. The resulting concrete structure may be of any architectural style and of any architectural configuration, including overhanging structures, angled or pitched roofs, et cetera. The resulting structure is of concrete construction, thereby providing a fireproof house which is virtually maintenance free, and most importantly, at the completion of the construction, the concrete structure is ready for occupancy, as compared to, for example, cast-in-place concrete structures, wherein a waiting period is required in order to insure proper curing of the concrete. Another important facet of the invention is that a multi-story concrete structure may be readily constructed, and work may progress at a rapid rate in that there is no requirement for insuring that the lower levels have been completely cured, as required in poured-in-place concrete construction techniques.

While the invention has been described in connection with several preferred embodiments of the modular concrete beam, the concrete structure, and the process of making the concrete structure, it will be understood that it is not intended to limit the invention to those embodiments. On the contrary, it is intended to cover all alternatives, modifications and equivalents, as may be included within the spirit and scope of the invention, as defined by the appended claims.

What is claimed is:

1. A concrete structure comprising a foundation, upstanding exterior and interior walls, and a roof, each of which is formed by interconnecting a plurality of modular concrete beams, each modular concrete beam being of integral construction having a generally rectangular cross-section to define two opposite sides, a top surface, and a bottom surface, said concrete structure having a central longitudinal aperture extending along the entire length of the beam, and further including a plurality of transverse aligned round holes extending through the opposite sides thereof, with the longitudinal aperture and the transverse holes intersecting to define a labyrinth of passageways within the concrete structure, elongated reinforcing bars extending along the entire length of the beam, one of said bars in each of the corners of the modular concrete beam;

mechanical bolting means for securing the foundation to the external and internal upstanding walls; said mechanical bolting means including bolt means rigidly connected to said foundation along the peripheral edge thereof and extending upwardly thereof; slotted plate means secured to the respective ends of the upstanding modular concrete beam forming said upstanding exterior and interior walls; an elongated channel shaped member having openings therein, said upstanding bolt extending through said opening in the elongated channel shaped members and the slotted plate member; and nut means for securing said modular concrete beams of the upstanding walls to the modular concrete beams of the foundation;

an elongated U-shaped channel member secured to the upper end of each upstanding wall to maintain same in alignment; and securing means for securing the roof portion of the concrete structure to the upstanding walls so as to complete the concrete structure.

2. A concrete structure as in claim 1 wherein service conduits extend through the foundation, upstanding exterior and interior walls and roof of said structure through the labyrinth of passageways defined by said abutting modular concrete beams.

3. A concrete structure as in claim 1 further including elongated reinforcing members extending through the aligned transverse holes of the abutting modular concrete structures to provide additional reinforcement for the concrete structure.

4. A concrete structure as in claim 1 further including a second story to said concrete structure formed of upstanding exterior and interior walls also made of modular concrete beams, along with a roof structure for said concrete structure.

5. A concrete structure as in claim 1 wherein the exterior and interior walls supporting tthe roof structure are of variable height in order to provide a pitched roof for the concrete structure.

6. A concrete structure comprising a foundation, upstanding exterior and interior walls, and a roof, each of which is formed by interconnecting a plurality of modular concrete beams, each modular concrete beam being of integral construction having a generally rectangular cross-section to define two opposite sides, a top surface, and a bottom surface, said concrete structure having a central longitudinal aperture extending along the entire length of the beam, and further including a plurality of transverse aligned round holes extending through the opposite sides thereof, with the longitudinal aperture and the transverse holes intersecting to define a labyrinth of passageways within the concrete structure, elongated reinforcing bars extending along the entire length of the beam, one of said bars in each of the corners of the modular concrete beam; said abutting modular concrete beams being interconnected by means of a tongue and groove arrangement defined along the opposite sides of said modular concrete beams, and further including a plurality of lateral connecting members comprising tubular metal members having a diameter corresponding to the diameter of said transverse round holes, and an intermediate external flange for limiting the insertion of said tubular members into the transverse round holes;

mechanical bolting means for securing the foundation to the external and internal upstanding walls;

an elongated U-shaped channel member secured to the upper end of each upstanding wall to maintain same in alignment; and securing means for securing the roof portion of the concrete structure to the upstanding walls so as to complete the concrete structure.

7. A concrete structure as in claim 6 wherein service conduits extend through the foundation, upstanding exterior and interior walls and roof of said structure through the labyrinth of passageways defined by said abutting modular concrete beams.

8. A concrete structure as in claim 6 further including a second story to said concrete structure formed of upstanding exterior and interior walls also made of modular concrete beams, along with a roof structure for said concrete structure.

9. A concrete structure as in claim 6 wherein the exterior and interior walls supporting the roof structure are of variable height in order to provide a pitched roof for the concrete structure.

* * * * *